United States Patent [19]

Sakurai et al.

[11] 4,310,780

[45] Jan. 12, 1982

[54] MAGNETIC FOCUSING STRUCTURE FOR THREE IN-LINE GUN TYPE COLOR PICTURE TUBES

[75] Inventors: Soichi Sakurai; Kyohei Fukuda, both of Mobara; Masanobu Takata, Ichimiyamachi, all of Japan

[73] Assignee: Hitachi, Ltd., Tokyo, Japan

[21] Appl. No.: 72,913

[22] Filed: Sep. 6, 1979

[30] Foreign Application Priority Data

Sep. 6, 1978 [JP] Japan ..... 53-108654

[51] Int. Cl.[3] ..... H01J 29/51

[52] U.S. Cl. ..... 313/412; 313/414

[58] Field of Search ..... 313/400, 411, 412, 413, 313/414, 441, 442, 443

[56] References Cited

U.S. PATENT DOCUMENTS 4,124,810 11/1978 Bortfeld et al. ..... 313/414 X 4,143,293 3/1979 Hosokoshi et al. ..... 313/409

FOREIGN PATENT DOCUMENTS 734,764 4/1943 Fed. Rep. of Germany ..... 313/412

50-26274 of 1975 Japan ..... 313/412

*Primary Examiner*—Robert Segal

*Attorney, Agent, or Firm*—Craig and Antonelli

[57] ABSTRACT

An electron beam focusing structure for a three in-line gun color picture tube comprises a permanent magnet or a focusing coil and a pair of magnetic yokes made of magnetic material high in magnetic permeability and having beam-passing through-holes and being disposed opposite to each other and perpendicular to the axis of the tube, for controlling the focusing magnetic fields generated for the plural electron beams by the permanent magnet or focusing coil in such a manner that the beams converge near the phosphor screen and focused respectively on the phosphor screen. The magnetic yokes are provided with cylindrical magnetic members extending in the axial direction of the tube, the cylindrical magnetic members for the center beam being different in length from the cylindrical magnetic members for the side beams, whereby the effective pole gap lengths for the respective beams between the magnetic yokes are so controlled as to provide optimum focusing fields for the respective beams. As an alternative form of the magnetic members, recesses are provided in the periphery of the throughholes with different depths.

22 Claims, 7 Drawing Figures

MAGNETIC FOCUSING STRUCTURE FOR THREE IN-LINE GUN TYPE COLOR PICTURE TUBES

CROSS-REFERENCES TO RELATED APPLICATIONS

This application relates to the subject matter described in an application Ser. No. 917,179 filed June 20, 1978, entitled "COLOR PICTURE TUBE WITH MANETIC FOCUSING SYSTEM" by Kyohei Fukuda and assigned to the assignee of the present application.

BACKGROUND OF THE INVENTION

This invention relates to an electromagnetic beam focusing type cathode ray tube and more particularly to an improvement on a structure for magnetically focusing plural beams in a three in-line gun type color picture tube.

The magnetic beam focusing structure of the three in-line gun color picture tube disclosed in the above-referenced application is a developed version of the magnetic beam focusing system used in a single-electron-gun picture tube described in the Japanese Utility Model Publication No. 26274/75 and controls the three electron beams produced by the three electron guns in such a manner that the beam spots of the three beams on the phosphor screen are spaced a short distance from one another and that each of the beam spots on the screen is prevented from being distorted. Such a magnetic focusing system comprises a pair of members of magnetic material arranged in spaced relation to each other in the direction of travel of the electron beams. Each of the members has a plurality of through holes or apertures for passing the respective electron beams. One member has the periphery of the through holes thereof magnetized to a polarity opposite to that of the periphery of the through holes of the other member, thereby forming a magnetic lens between each corresponding pair of the through holes passing the electron beams.

The means for magnetizing the magnetic material members, i.e. magnetic field generating means, is at least one magnet provided in the neck portion of the tube. Alternatively, the means may be a focusing coil or a cylindrical permanent magnet disposed around the neck portion. Since the shapes of the magnetic field generating means are restricted by the limitations to accomodating space, weight and working technique, as shown in FIG. 5 of the above-referenced application, then it is difficult and also impractical in the fabrication of a three in-line gun assembly to arrange the shape of the magnetic field generating means in a symmetrical relation to all the in-line through-holes. Complicated magnet structure makes the cost high. Also, in the case where a magnetic focusing coil is used around the neck portion of the tube, the coil cannot be arranged in a uniform geometrical relation to the in-line through-holes. Namely, a uniform magnetic flux distribution is not provided over all of the three in-line beams. Accordingly, the focusing magnetic field for the center beam established between the peripheries of the paired through-holes of the magnetic material members by the magnetizing means becomes necessarily different in distribution from the focusing magnetic field for each of the side beams established in a similar manner. In practice, therefore, the focusing magnetic fields deviate from their optimum conditions to some extent. This degrades the focusing quality so that the respective beams cannot be exactly focused on the phosphor screen.

SUMMARY OF THE INVENTION

An object of this invention is to provide a magnetic beam focusing structure for a three in-line gun color picture tube, which controls the focusing fields for three in-line beams to their optimum conditions so that the respective beams are correctly focused on the phosphor screen.

Another object of this invention is to provide a magnetic beam focusing structure for a three in-line gun picture tube, which has such a specific arrangement of magnetic poles as to compensate the uneven distributions of the focusing fields for the respective beams due to the asymmetric geometry of the magnetizing means with respect to the in-line through-holes formed for letting the beams pass therethrough in the magnetic material members provided for focusing the beams in the neck portion of the bulb.

Yet another object of this invention is to provide a magnetic beam focusing structure for a three in-line gun picture tube, which can compensate the uneven geometry of the magnetizing means in a relatively simple manner and control the focusing fields for the respective beams to their optimum conditions.

According to this invention, which has been made to attain the above objects, substantially platelike magnetic pole pieces have beam-passing through holes are provided with cylindrical magnetic members or recesses in the periphery of the through holes for focusing the beams, and the axial gap lengths between the cylindrical magnetic members and/or the bottoms of the recesses for the center and side beams are so differentially controlled as to compensate the asymmetric geometry of the magnetizing means with respect to the in-line throughholes, whereby the optimum focusing fields may be produced for the respective beams.

BRIEF DESCRIPTION OF THE DRAWINGS

Throughout the figures, like or equivalent parts are designated by the same reference numerals.

DESCRIPTION OF THE PREFERRED EMBODIMENTS

For a better understanding of this invention, a typical example of the conventional magnetic focusing device will be explained with the aid of FIGS. 1 and 2 before the description of the embodiments of this invention.

Figure 1:
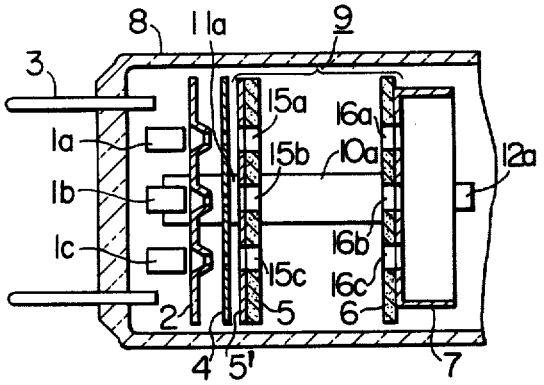
FIG. 1 PRIOR ART
FIG. 1 is a sectional plan view of a neck portion of a conventional magnetic focusing type color picture tube having three in-line guns.
Figure 2:
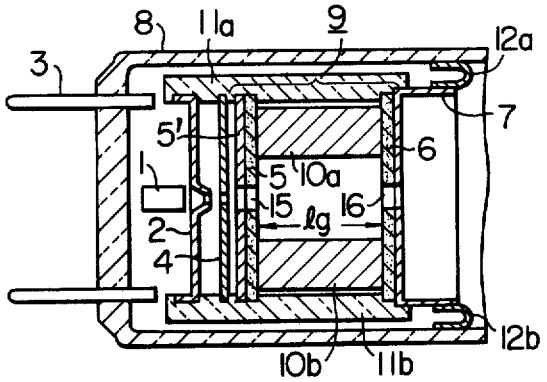
FIG. 2 PRIOR ART
FIG. 2 is another longitudinal section of the same portion as shown in FIG. 1, with the sectional plane perpendicular to that of FIG. 1.

FIG. 1 and FIG. 2 respectively show in longitudinal sections with sectional planes perpendicular to each other, an electromagnetic focusing type three-in-line-gun cathode ray tube for generating plural electron beams. In FIGS. 1 and 2, reference numerals 1*a*, 1*b*, and 1*c* designate the respective cathodes of three-in-line guns; 2 the first grid; 3 a stem lead; 4 the second grid; 5 and 6 magnetic pole pieces made of magnetic material and disposed opposite to each other; 7 a shield cup; 8 the neck portion of glass bulb; 9 the third grid; 10*a* and 10*b* permanent magnets (for generating magnetic fields); 11*a* and 11*b* glass support members; and 12*a* and 12*b* resilient members for high voltage application. The electrons emitted by the cathodes 1*a*–1*c* are focused by means of the first and the second grids 2 and 4 and focused in the crossover area between the grids 2 and 4. Then, the focused electrons are accelerated by the third grid 9 to which a high anode voltage (i.e. positive potential) is applied through the resilient members 12*a* and 12*b*, diverging with certain angles through within the third grid 9. The third grid 9 is constituted by a pair of magnetic pole piece plates 5 and 6 made of magnetic material having high magnetic permeability, disposed opposite to each other, and plates 5' of non-magnetic material adhered to the surface of the pole piece plate 5 opposite to the second grid 4. The pair of magnetic pole pieces 5 and 6 have through-holes 15*a*–15*c* and 16*a*–16*c* through which three electron beams pass respectively. The magnetic pole pieces 5 and 6 may also be provided with perforations to form such magnetic reluctances as to cause the induced magnetic field to be symmetrical with respect to the bulb axis. The permanent magnets 10*a* and 10*b* coupled to the pole pieces 5 and 6 establish focusing fields for the respective electron beams between the magnetic poles formed at the peripheries of the through-holes 15*a*–15*c* and 16*a*–16*c* upon magnetization of the pole pieces. The electron beams traveling within the third grid 9 are focused by the focusing fields so that the respective in-line beams may be focused to form the smallest beam spots on the phosphor screen of the tube. However, since the through-holes of the pole pieces 5 and 6 in the three in-line guns, respectively have different geometrical relations with respect to the permanent magnet 10 (i.e. magnetic field generating means), that is, are differently spaced therefrom as shown in FIGS. 1 and 2, the focusing magnetic fields established between the pairs of the magnetic poles, i.e., the peripheries of the through-holes, are different from one another. With the in-line gun assembly shown in FIGS. 1 and 2, the traveling path of the center beam emitted by the center gun is nearer to the permanent magnet 10 than that of each of the side beams emitted by the side guns, so that although the magnetic pole pieces 5 and 6 are made of magnetic material having high magnetic permeability, the focusing field for the center beam is slightly more intense than those for the side beams. Accordingly, in a practical case, those focusing fields are so adjusted as to meet a certain compromise condition that the center beam focusing field is slightly more intense than its optimal value while the side beam focusing field is slightly weaker than their optimal values. This causes a somewhat lowered degree of focusing for each beam with the result that the beam spots on the phosphor screen have uneven diameters.

Figure 3:
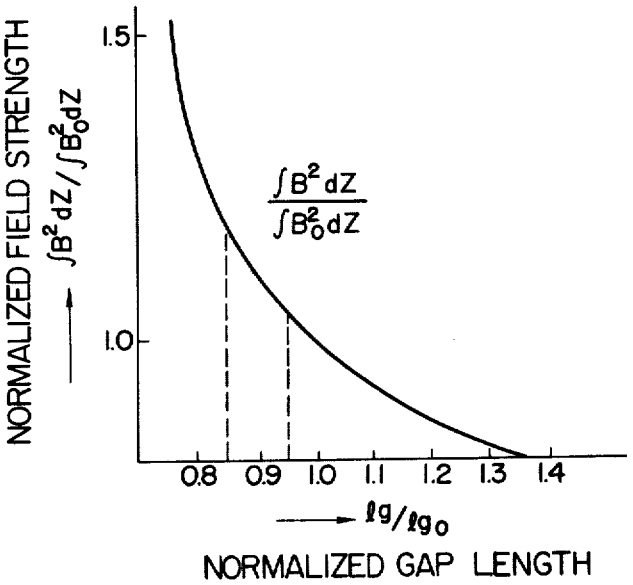
FIG. 3 illustrates in graphical representation the principle of this invention, showing the relationship between the gap length of the magnetic poles for generating a focusing magnetic field and the focusing field or the focal distance.

The present inventors, after close investigation of the characteristics of the magnetic focusing lenses established within the third grid 9, have obtained such a relationship as shown in FIG. 3. Namely, the relationship of the distance $l_g$ between the paired poles formed by the axially opposite through-holes 15*a* and 16*a*, 15*b* and 16*b*, or 15*c* and 16*c*, to the magnetic field (in the direction Z of the bulb axis) B along the axis passing through the centers of the through-holes for each of three beams was measured and the quantity $\int B^2dZ$ was plotted against the axial gap length $l_g$ between the opposite magnetic pole pieces, where the integral was taken over a range of Z from the crossover point for $Z=0$ to the inner surface of the phosphor screen. It should be noted that the abscissa and the ordinate of the coordinate system in FIG. 3 are both measured for convenience by the normalized values calculated by using $l_{go}=6$ mm and $B_o$ for $l_g=l_{go}$. It is well known that the focal distance f of an electron beam is related to the associated focusing field B such that $1/f=K\int B^2dZ$, where K is the quantity determined depending on the potential along the path of the electron beam in question. Therefore, the characteristic shown in FIG. 3 is considered to directly show the relationship between the gap length $l_g$ between poles of the pole pieces 5 and 6 and the focal distance f of the beam. In a conventional typical cathode ray tube of electromagnetic focusing type, the ratio of the focusing field $\int B_c^2dZ$ for the center beam to the focusing field $\int B_s^2dZ$ for each side beam, ($B_c$ and $B_s$ are the magnetic fields along the paths of the center beam and the side beam, respectively) was 1/0.85 to 1/0.95. It is therefore understood from FIG. 3 that in order to render these focusing fields substantially equal to each other, it is only necessary to adjust the gap length between the paired poles for the side beam to about 0.85 to 0.95 times the gap length between paired poles for the center beam.

Figure 4:
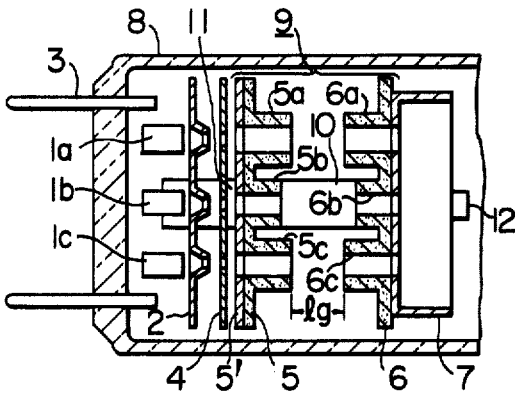
FIG. 4 shows in longitudinal section a magnetic focusing device as an embodiment of this invention, the device using a permanent magnet and being mounted in the gun assembly of a color picture tube.
Figure 5:
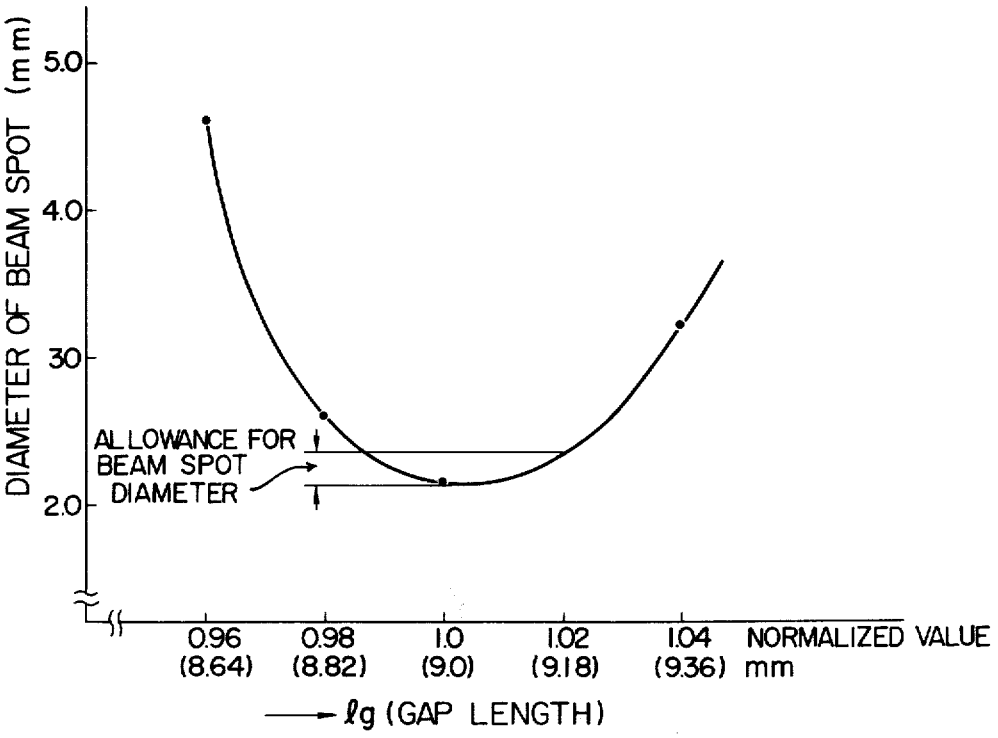
FIG. 5 illustrates in graphical representation an effect obtained by virtue of the structure shown in FIG. 4.

FIG. 4 shows in longitudinal section a magnetic focusing device (or structure) as an embodiment of this invention, which uses a permanent magnet as a magnetic field generating means and therefore can be considered as an improvement on the device shown in FIGS. 1 and 2. As shown in FIG. 4, the magnetic focusing device provided within the third grid 9 comprises magnetic pole pieces 5 and 6 opposed to each other, through-holes 15*a* –15*c* and 16*a*–16*c* formed respectively in the pole piece 5 and 6 for passing the three in-line electron beams therethrough and cylindrical magnetic members 5*a*–15*c* and 6*a*–6*c* provided on the peripheries to the through-holes 15*a*–15*c* and 16*a*–16*c*, respectively. The inner walls of the through-holes and the adjacent cylindrical members establish a magnetic pole upon magnetization. A permanent magnet 10 is disposed nearly at the center of the arrangement of the in-line through-holes between-the members 5*b* and 6*b*. Each of the magnetic members projects from the surface of the pole piece plate as shown. The gap lengths between the paired members (5*a*, 6*a*), (5*b*, 6*b*), and (5*c*, 6*c*) are respectively 7.4 mm, 8.0 mm and 7.4 mm, which are determined in view of the relationship shown in FIG. 3. Namely, as shown in FIG. 4, the magnetic members for the side beams are longer by 0.3 mm than the magnetic members for the center beam. The above numerical data are for a 14-inch 90°-deflection color picture tube with a rated anode voltage of 22 KV, in which the diameter of each of the through-holes 15a–15c and 16a–16c is 5.5 mm, the diameter of the neck portion of the bulb is 29 mm, and the permanent magnet has a diameter of 6 mm, a length of 9 mm and a weight of about 5 kg. In this case, both the center beam and the side beams were well focused on the phosphor screen. The advantageous effect of the embodiment shown in FIG. 4 will be apparent from the following description. The gap length $l_g$ between the magnetic members is related to the diameter of the beam spot on the phosphor screen as shown in FIG. 5. The characteristic curve shown in FIG. 5 exhibits great dependency of the diameter of the beam spot upon the gap length $l_g$. If the allowance for the beam spot diameter is 10%, $l_g$ is 1.5–2%. In FIG. 5, the abscissa representing the gap length $l_g$ is measured in the normalized value as well as the actual value. It is appreciated that the amplitude of the difference between the diameter of the spot of the center beam and the diameter of the spot of the side beam, focused on the phosphor screen according to this invention is smaller than half the corresponding amplitude according to the prior art.

Figure 6:
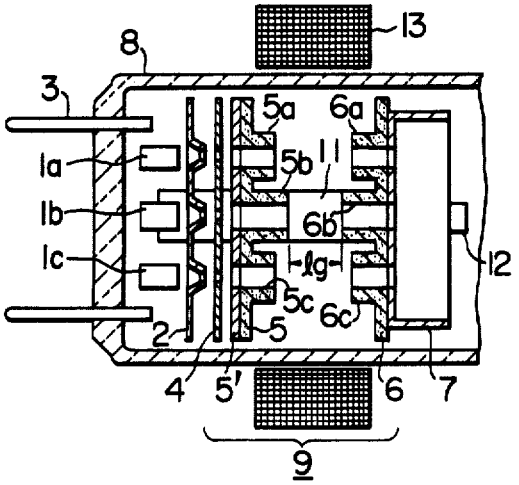
FIG. 6 shows in longitudinal section a magnetic focusing device as another embodiment of this invention, the device using a focusing coil outside of the bulb neck portion.

FIG. 6 shows in longitudinal section a magnetic focusing structure as another embodiment of this invention, using a focusing coil 13 as a magnetic field generating means, the coil 13 being provided around the neck portion 8 of the bulb. In this case, to obtain good results, it was necessary that the gap length between opposite magnetic members for the side beams nearer to the winding of the coil 13 than the center beam was to be about 1.05 to 1.15 times longer than the gap length between the opposite magnetic members for the center beam, as shown in FIG. 6. Namely, the cylindrical members 5b and 6b for the center beam are longer than the cylindrical members (5a, 6a) and (5c, 6c) for the side beams. The focusing coil 13 has an inner diameter of 30 mm, an outer diameter of 55 mm and a length of 15 mm in the axial direction of the neck portion 8. The other parts or members of the embodiment are the same as those used in the embodiment as shown in FIG. 4.

As described above, according to this invention, more than one beam can be focused by the respectively optimum focusing magnetic fields and then focused on the phosphor screen to produce optimum beam spots thereon.

Further, the provision of cylindrical members protruding from the flat-plate pole pieces has an advantage of increasing the intensities of the effective magnetic fields established between the poles. In the embodiments shown in FIGS. 1 and 2, only one of the pole pieces 5 and 6 may be provided with the cylindrical protruding members while in the other pole piece the peripheries of the through-holes serve as the poles in order to provide different pole gap lengths for the respective in-line beams.

Figure 7:
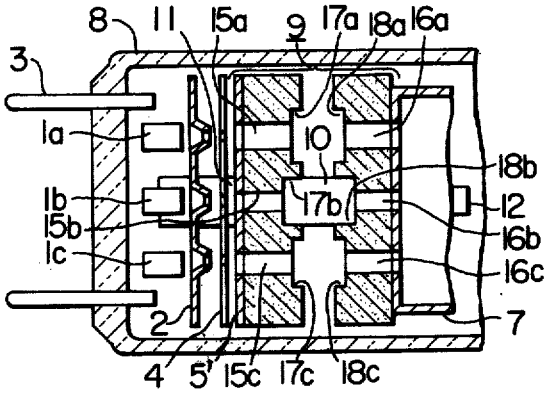
FIG. 7 is a sectional view of another embodiment of this invention.

FIG. 7 shows an alternative form of the yoke structure of FIG. 4 or 6, in which the pole piece plates 5 and 6 have a relatively large thickness, and recesses or openings 17a–17c and 18a–18c are provided to surround the through-holes 15a–15c and 16a–16c, respectively with different axial depths in the periphery thereof. The recesses may be step-wise, tapered, and conical relative to the junction of the through-holes.

What we claim is:

1. In an electron beam magnetic focusing lens structure for a three in-line gun color picture tube, having means for generating magnetic fields and a pair of mutually-opposed plate-like magnetic pole pieces made of magnetic material having high magnetic permeability, said pair of magnetic pole pieces having beam-passing in-line through-holes and being disposed opposite to each other and perpendicular to the axis of the tube, for controlling focusing magnetic fields generated by said magnetic field generating means for center and side electron beams in such a manner that said beams converge near the phosphor screen and are focused respectively on said phosphor screen, said magnetic field generating means being disposed with respect to said pair of pole pieces so that magnetic focusing lenses are formed between mutually-opposed through-holes thereof, the improvement wherein at least one of said pole pieces is provided with cylindrical magnetic members extending coaxially from said through-holes toward the opposite pole piece, said magnetic members having differential axial lengths so that the gap length between the mutually-opposed pole pieces for the center beam is different from the gap lengths between the mutually-opposed pole pieces for the side beams, the inner walls of the through-hole and the inner surface of the cylindrical magnetic member establishing a magnetic pole upon magnetization by said field generating means, to thereby equalize the respective focusing fields for the respective electron beams established between the mutually-opposed pole pieces.

2. An electron beam magnetic focusing lens structure as claimed in claim 1, wherein said magnetic field generating means is a permanent magnet disposed along the path of the center beam in the axial direction of the tube and wherein said cylindrical magnetic members for said center beam are shorter than said cylindrical magnetic members for the side beams in such a manner that the gap length between said cylindrical magnetic members for said side beam equals about 0.85 to 0.95 times the gap length between said cylindrical magnetic members for said center beam.

3. An electron beam magnetic focusing lens structure as claimed in claim 1, wherein said magnetic field generating means is provided around the neck portion of said tube and wherein said cylindrical magnetic members for the center beam are longer than said cylindrical magnetic members for the side beams in such a manner that the gap length between said cylindrical magnetic members for said side beam equals about 1.05 to 1.15 times the gap length between said cylindrical magnetic members for said center beam.

4. An electron beam magnetic focusing lens structure as claimed in claim 3, wherein said magnetic field generating means are magnet coils or permanent magnets.

5. An electron beam focusing structure as claimed in claim 1, 2, 3 or 4, wherein each of said pair of magnetic pole pieces and the projecting magnetic members provided thereon are in an integral form.

6. In an electron beam magnetic focusing lens structure for a three in-line gun color picture tube, having means for generating magnetic fields and a pair of plate-like, mutually-opposed magnetic pole pieces formed of magnetic material having high magnetic permeability, said magnetic pole pieces having beam-passing in-line through-holes and being disposed opposite to each other and perpendicular to the axis of the tube, for controlling beam focusing magnetic fields generated by said field generating means for center and side electron beams in such a manner that said beams converge near the phosphor screen of the tube and are focused respectively on said phosphor screen, said magnetic field generating means being disposed with respect to said pole pieces so that magnetic focusing lenses are formed between mutually-opposed through-holes thereof, the improvement wherein at least one of said opposite pole pieces is provided with recesses surrounding the respective through-holes in the surface thereof facing the other pole pieces, the depth of the recess surrounding the through-hole for the center beam being different than the depths of the recesses surrounding the through-holes for the side beams, so that the through-hole for the center beam has a wall length which is different along the beam path thereof than the wall lengths of the through-holes for the side beams to that the respective mutually-opposed through-holes for the side beams provide different pole gap lengths between the opposite pole pieces than provided for the center beam to thereby compensate for unevenness of the beam focusing fields for the respective beams caused by the difference in distance of the field generating means relative to the through-holes for the center beam and those for the side beams.

7. An electron beam magnetic lens focusing structure as claimed in claim 6, wherein said magnetic field generating means is a permanent magnet disposed along the path of the center beam in the axial direction of the tube.

8. An electron beam magnetic lens focusing structure as claimed in claims 6 or 7, wherein the depth of the recess surrounding the through-hole for said center beam is greater than the depth of the recesses surrounding the through-holes for the side beams.

9. An electron beam magnetic lens focusing structure as claimed in claim 6, wherein both of said pole pieces have recesses in the focusing surfaces thereof surrounding said through-holes.

10. An electron beam magnetic lens focusing structure as claimed in claim 1, wherein said magnetic field generating means is a permanent magnet disposed along the path of the center beam in the axial direction of the tube.

11. An electron beam magnetic lens focusing structure as claimed in claims 1 or 10, wherein the length of the cylindrical magnetic member surrounding said through-hole for the center beam is shorter than the cylindrical magnetic members surrounding the through-holes for said side beams.

12. An electron beam magnetic lens focusing structure as claimed in claim 1, wherein both of said pole pieces are provided with facing cylindrical magnetic members extending coaxially from the through-holes therein toward the other pole piece.

13. An electron beam magnetic lens focusing structure as claimed in claim 1, wherein said magnetic field generating means is a coil surrounding the neck portion of the picture tube.

14. An electron beam magnetic lens focusing structure as claimed in claims 1 or 13, wherein the length of the cylindrical magnetic member surrounding said through-hole for the center beam is longer than the cylindrical magnetic members surrounding the through-holes for said side beams.

15. In a color picture tube having an electron gun including a plurality of cathodes disposed in-line in a neck portion of said tube for generating center and side in-line electron beams, and magnetic focusing means in the form of a pair of magnetic pole pieces of high permeability spaced in the axial direction of the tube and having through-holes disposed therein in-line in the axial direction of the tube for permitting said center and side electron beams emitted from the cathodes to pass therethrough, respectively, and magnetizing means for magnetizing one of said pair of magnetic pole pieces in one polarity and the other of said pair of magnetic pole pieces in the other polarity to produce a plurality of magnetic focusing lenses therebetween, each of said magnetizing focusing lenses being present between mutually-opposed through holes of said pair of the magnetic pole pieces so as to have a lens axis coinciding with a center-to-center line of the mutually-opposed through holes, the improvement wherein at least one of said pole pieces is provided with cylindrical magnetic members extending coaxially from said through-holes toward the opposite pole piece, said magnetic members having different axial lengths so that the gap length between the mutually-opposed pole pieces for the center beam is different from the gap lengths between the mutually-opposed pole pieces for the side beams, the inner walls of the through-hole and the inner surface of the cylindrical magnetic member establishing a magnetic pole upon magnetization by said magnetizing means, to thereby equalize the respective focusing fields for the respective electron beams established between the mutually-opposed pole pieces.

16. A color picture tube as claimed in claim 15, wherein said magnetizing means is a permanent magnet disposed along the path of the center beam in the axial direction of the tube.

17. A color picture tube as claimed in claims 15 or 16, wherein said cylindrical magnetic member for said center beam is shorter than said cylindrical magnetic members for the side beams.

18. A color picture tube as defined in claims 15 or 16, wherein both of said pole pieces are provided with facing cylindrical magnetic members extending coaxially from the through-holes therein toward the other pole piece.

19. A color picture tube as claimed in claim 18, wherein the gap length between said cylindrical magnetic members for the side beams equals about 0.85 to 0.95 times the gap length between said cylindrical magnetic members for said center beam.

20. A color picture tube as defined in claim 15, wherein said magnetizing means is provided around the neck portion of said tube and said cylindrical magnetic member for said center beam is longer than said cylindrical magnetic members for the side beams.

21. A color picture tube as claimed in claims 15 or 20, wherein both of said pole pieces are provided with facing cylindrical magnetic members extending coaxially from the through-holes therein toward the other pole piece.

22. A color picture tube as claimed in claim 21, wherein the gap length between said cylindrical magnetic members for said side beams equals about 1.05 to 1.15 times the gap length between said cylindrical magnetic members for said center beam.

* * * * *